US006663722B1

(12) United States Patent
Higashino et al.

(10) Patent No.: US 6,663,722 B1
(45) Date of Patent: Dec. 16, 2003

(54) METHOD OF CLEANING FLUORINE-CONTAINING RUBBER MOLDED ARTICLE FOR SEMICONDUCTOR PRODUCTION APPARATUSES AND CLEANED MOLDED ARTICLE

(75) Inventors: Katsuhiko Higashino, Settsu (JP); Tsuyoshi Noguchi, Settsu (JP); Mitsuru Kishine, Settsu (JP); Masanori Hasegawa, Settsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/646,949

(22) PCT Filed: Mar. 24, 1999

(86) PCT No.: PCT/JP99/01518

§ 371 (c)(1),
(2), (4) Date: Sep. 25, 2000

(87) PCT Pub. No.: WO99/49997

PCT Pub. Date: Oct. 7, 1999

(30) Foreign Application Priority Data

Mar. 25, 1998 (JP) ..... 10-77781
Jun. 10, 1998 (JP) ..... 10-161988
Jan. 12, 1999 (JP) ..... 11-5878

(51) Int. Cl.[7] ..... B08B 3/04

(52) U.S. Cl. ..... 134/26; 210/900; 134/1.1; 134/28; 134/29; 134/34; 134/36; 134/41; 134/42

(58) Field of Search ..... 210/900; 134/26, 134/1.1, 28, 29, 34, 36, 41, 42

(56) References Cited

U.S. PATENT DOCUMENTS 3,484,337 A 12/1969 Starita ..... 428/420
3,654,940 A * 4/1972 Ritzi ..... 134/2
4,883,775 A * 11/1989 Kobayashi ..... 134/4
5,073,203 A 12/1991 Al-Ghatta ..... 134/11
5,378,768 A * 1/1995 Ogisu et al. ..... 427/299
5,468,561 A * 11/1995 Cho ..... 428/195
5,488,964 A * 2/1996 Murakami et al. ..... 118/326
5,585,012 A 12/1996 Wu et al. ..... 216/71
5,712,040 A * 1/1998 Nakahara et al. ..... 428/336
6,146,923 A * 11/2000 Ohmi et al. ..... 118/667

FOREIGN PATENT DOCUMENTS

JP 61-42919 3/1986 ..... H01L/21/304
JP 63-310683 12/1988 ..... B08B/3/02
JP 2-98133 4/1990 ..... H01L/21/304
JP 2-239912 9/1990 ..... B29B/13/00
JP 3-288433 12/1991 ..... H01L/21/304
JP 4-318036 11/1992 ..... C08J/7/00
JP 6-293069 10/1994 ..... B29C/59/02
JP 6-343932 12/1994 ..... B08B/3/10
JP 7-14817 1/1995 ..... H01L/21/304
JP 7-58075 3/1995 ..... H01L/21/304
JP 7-308567 11/1995 ..... B01J/3/00
JP 8-5140 1/1996 ..... B29C/71/00
JP 9-153475 6/1997 ..... H01L/21/304
JP 10-436 1/1998 ..... B08B/3/08
JP 10-50649 2/1998

OTHER PUBLICATIONS

Werner Kern, Handbook of Semiconductor Wafer Cleaning Technology, Noyes Publications, 1993, p. 78, Table 4.*
English language translation of International Preliminary Examination Report for PCT/JP99/01518.
International Search Report.
International Preliminary Examination Report for PCT/JP99/01518 dated Jun. 5, 2000.

* cited by examiner

*Primary Examiner*—Sharidan Carrillo
(74) *Attorney, Agent, or Firm*—Sughrue Mion, PLLC

(57) ABSTRACT

To provide a novel and effective cleaning method which can give a cleaned fluorine-containing rubber molded article for semiconductor production apparatuses.

The method of cleaning the fluorine-containing rubber molded article for semiconductor production apparatuses, which comprises washing the fluorine-containing rubber molded article at least once with ultra pure water which has a metal content of not more than 1.0 ppm and does not contain fine particles of not less than 0.2 $\mu$m in an amount of more than 300 per 1 ml.

10 Claims, No Drawings

METHOD OF CLEANING FLUORINE-CONTAINING RUBBER MOLDED ARTICLE FOR SEMICONDUCTOR PRODUCTION APPARATUSES AND CLEANED MOLDED ARTICLE

TECHNICAL FIELD

The present invention relates to a method of cleaning a fluorine-containing rubber molded article such as a sealing material for semiconductor production apparatuses, the cleaned molded article and semiconductor production apparatuses such as etching equipment which are equipped with the molded article.

BACKGROUND ART

In the field of semiconductor industries, sealing materials produced from a silicone material, fluorosilicone material, ethylene/propylene/diene terpolymer (EPDM), and the like have been used generally as molded articles such as sealing materials for semiconductor production apparatuses, and from the viewpoint of excellent heat resistance, plasma resistance and corrosive gas resistance, fluorine-containing rubber materials such as vinylidene fluoride/hexafluoropropylene copolymer rubber, vinylidene fluoride/tetrafluoroethylene/hexafluoropropylene copolymer rubber, tetrafluoroethylene/perfluoro(alkyl vinyl ether) copolymer rubber and tetrafluoroethylene/propylene copolymer rubber have been used for molded articles to be used under particularly strict conditions.

In a production process of semiconductors, there arise organic residues such as photoresist residue, organic solvent residue, synthetic wax and fatty acid derived from human body, inorganic contaminants such as sodium, potassium, gold, iron and copper, and particles. It is important to remove them and not to carry them into the following high temperature heat treating step. Attention is paid particularly to cleaning of a wafer, and strict control on chemicals to be used therefor is demanded.

However for example, since a minimum pattern of 64 Mbit DRAM is 0.35 $\mu$m, it is necessary to keep fine particles of as small as about 0.02 $\mu$m to about 0.03 $\mu$m under control, but the present situation is such that controlling of chemicals to be used for cleaning of wafer up to the above-mentioned level is technically difficult.

The present inventors supposed that only cleaning of semiconductor products such as silicon wafer (article to be processed) by etching and washing is not enough and paid attention to cleaning of molded members as components of semiconductor production apparatuses, particularly sealing materials thereof.

The reason why attention was paid to the molded articles such as sealing materials to be used on semiconductor production apparatuses was that particles and metal components are considered to possibly adhere to a surface of semiconductor, thereby causing lowering of yield.

As a method of cleaning the molded articles such as sealing materials, there have been usually employed, for example, a method of wiping them with an absorbent cotton impregnated with a solvent such as isopropyl alcohol. However it is still impossible to sufficiently reduce an amount of particles adhering to the molded articles and a content of metal components, and even if the above-mentioned chemicals used for cleaning of wafer, etc. are used, cleaning enough to cope with high integration of semiconductors and fine patterning has not yet been achieved.

In view of the above-mentioned fact, objects of the present invention are to provide a novel and effective cleaning method capable of giving cleaned fluorine-containing rubber molded articles for semiconductor production apparatuses, and further to provide semiconductor production apparatuses which can reduce sufficiently particles and metal components resulting from molded articles such as sealing materials.

DISCLOSURE OF INVENTION

The present invention relates to the method of cleaning a fluorine-containing rubber molded article for semiconductor production apparatuses, which comprises washing the fluorine-containing rubber molded article once or two or more times preferably at a temperature of not less than 80° C. with ultra pure water which has a metal content of not more than 1.0 ppm and does not contain fine particles of not less than 0.2 $\mu$m in an amount of more than 300 per 1 ml.

The present invention also relates to the method of cleaning a fluorine-containing rubber molded article for semiconductor production apparatuses, which comprises washing the fluorine-containing rubber molded article once or two or more times with an organic compound or inorganic compound which has a metal content of not more than 1.0 ppm, does not contain fine particles of not less than 0.5 $\mu$m in an amount of more than 200 per 1 ml and is in liquid form at a washing temperature.

Further the present invention relates to the fluorine-containing rubber molded article for semiconductor production apparatuses which is subjected to cleaning by dry etching.

Further the present invention relates to the method of cleaning a fluorine-containing rubber molded article for semiconductor production apparatuses, which comprises extraction cleaning.

Further the present invention relates to the method of cleaning a fluorine-containing rubber molded article for semiconductor production apparatuses, in which after a method of washing with an organic compound or inorganic compound having an oxidizing ability and a method of washing with an inorganic compound having a high ability of dissolving a metal are carried out in this order or in reverse order, washing with ultra pure water is conducted and then removal of water is carried out in a clean inert gas or air. Still further the present invention relates to the method of cleaning a fluorine-containing rubber molded article for semiconductor production apparatuses, in which after washing with an aqueous solution of a mixture of $H_2SO_4$ and $H_2O_2$ which has a metal content of not more than 1.0 ppm and does not contain fine particles of not less than 0.5 $\mu$m in an amount of more than 200 per 1 ml is carried out, washing with an aqueous solution of HF which has a metal content of not more than 1.0 ppm and does not contain fine particles of not less than 0.5 $\mu$m in an amount of more than 200 per 1 ml, washing with ultra pure water which has a metal content of not more than 1.0 ppm and does not contain fine particles of not less than 0.2 $\mu$m in an amount of more than 300 per 1 ml and then removing of water in a clean inert gas or air which does not contain fine particles of not less than 0.2 $\mu$m in an amount of more than 26 per 1 liter and has a content of organic component (TOC) of not more than 0.1 ppm are carried out.

Further the present invention relates to the fluorine-containing rubber molded article for semiconductor production apparatuses, in which the number of particles of not less than 0.2 $\mu$m being present on the surface thereof is not more than 200,000/cm$^2$.

Further the present invention relates to the fluorine-containing rubber molded article for semiconductor production apparatuses, in which the molded article is subjected to cleaning by one of the above-mentioned cleaning methods or by a combination of two or more thereof and the number of particles of not less than 0.2 $\mu$m being present on the surface thereof is not more than 200,000/cm$^2$.

The present invention also relates to the semiconductor production apparatuses equipped with the above-mentioned fluorine-containing rubber molded article, for example, etching equipment, washing equipment, exposure equipment, grinding equipment, film forming equipment and ion diffusion and implantation equipment.

BEST MODE FOR CARRYING OUT THE INVENTION

Firstly the fluorine-containing rubber constituting the fluorine-containing rubber molded article for semiconductor production apparatuses of the present invention is explained below.

Non-restricted examples of the fluorine-containing rubber constituting the fluorine-containing rubber molded article for semiconductor production apparatuses of the present invention are those which have been used for molding materials for sealing materials nd the like. For example, there are a copolymer rubber represented by the formula (1):

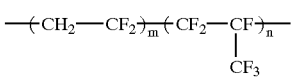

wherein m is from 85 to 60, n is from 15 to 40, or the formula (2):

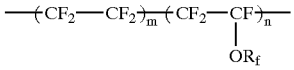

wherein m is from 95 to 50, n is from 5 to 50, $R_f$ is a perfluoroalkyl group having 1 to 8 carbon atoms, a terpolymer rubber represented by the formula (3):

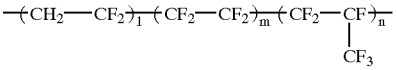

wherein 1 is from 85 to 20, m is from 0 to 40, n is from 15 to 40, a terpolymer rubber represented by the formula (4):

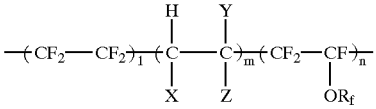

wherein 1 is from 95 to 45, m is from 0 to 10, n is from 5 to 45, X, Y and Z are individually fluorine atom or hydrogen atom, $R_f$ is a perfluoroalkyl group having 1 to 8 carbon atoms, a terpolymer rubber represented by the formula (5):

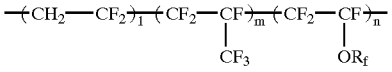

wherein 1 is from 95 to 35, m is from 0 to 30, n is from 5 to 35, $R_f$ is a perfluoroalkyl group having 1 to 8 carbon atoms, and the like. Among them, from the viewpoint of chemical resistance, heat resistance and plasma resistance, it is preferable to use the copolymer rubbers represented by the formulae (1) and (2) and the terpolymer rubber represented by the formula (3).

Further as the fluorine-containing rubber constituting the fluorine-containing rubber sealing material in the present invention, there are copolymers comprising an elastomeric segment copolymer and a non-elastomeric segment copolymer.

The elastomeric segment represents a non-crystalline segment having a glass transition temperature of not more than 25° C. Example of the preferred components is, for instance, TFE/PAVE/monomer giving a curing site (45 to 90/10 to 50/0 to 5 in % by mole, hereinafter the same), more preferably 45 to 80/20 to 50/0 to 5, especially 53 to 70/30 to 45/0 to 2.

Examples of the monomer giving a curing site are, for instance, vinylidene fluoride, iodine-containing monomer represented by $CX_2{=}CX{-}R_f^3CHRI$, in which X is H, F or $CH_3$, $R_f^3$ is a fluoroalkylene group, perfluoroalkylene group, fluoropolyoxyalkylene group or perfluoropolyoxyalkylene group, R is H or $CH_3$, nitrile group-containing monomer represented by

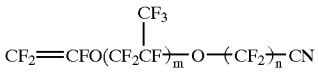

wherein m is from 0 to 5, n is from 1 to 3, bromine-containing monomer, and the like. Usually the iodine-containing monomer, etc. are suitable.

Examples of the non-elastomeric segment copolymer are:

(1) VdF/TFE (0 to 100/100 to 0), particularly VdF/TFE (70 to 99/30 to 1), PTFE or PVdF;

(2) ethylene/TFE/HFP (6 to 43/40 to 81/10 to 30), 3,3,3-trifluoropropylene-1,2-trifluoromethyl-3,3,3-trifluoropropylene-1/PAVE (40 to 60/60 to 40);

(3) TFE/$CF_2{=}CF{-}R_f^1$ (amount exhibiting non-elastomeric property, namely not more than 15% by mole of $CF_2{=}CF{-}R_f^1$, in which $R_f^1$ is $CF_3$ or $OR_f^2$, $R_f^2$ is a perfluoroalkyl group having 1 to 5 carbon atoms);

(4) VdF/TFE/CTFE (50 to 99/30 to 0/20 to 1);

(5) VdF/TFE/HFP (60 to 99/30 to 0/10 to 1);

(6) ethylene/TFE (30 to 60/70 to 40);

(7) polychlorotrifluoroethylene (PCTFE);

(8) ethylene/CTFE (30 to 60/70 to 40);

and the like. Among them, from the viewpoint of chemical resistance and heat resistance, non-elastomeric copolymers such as PTFE and TFE/$CF_2{=}CF{-}R_f^1$ are particularly preferable.

The above-mentioned fluorine-containing rubber can be prepared by the molding methods such as compression molding and injection molding.

Then the first method of cleaning the fluorine-containing rubber molded article for semiconductor production apparatuses according to the present invention is explained below.

The first cleaning method of the present invention is the method of cleaning the fluorine-containing rubber molded article for semiconductor production apparatuses, which comprises washing the fluorine-containing rubber molded article once or two or more times with ultra pure water which has a metal content of not more than 1.0 ppm and does not contain fine particles of not less than 0.2 μm in an amount of more than 300 per 1 ml.

The "ultra pure water" means water which has a metal content of not more than 1.0 ppm and does not contain fine particles of not less than 0.2 μm in an amount of more than 300 per 1 ml. From the viewpoint of reduction of mixing of metals into a sealing material and reduction of adherence of fine particles onto a molded article, it is preferable that the metal content is not more than 0.8 ppm and the number of fine particles of not less than 0.2 μm is 250 or less per 1 ml, especially the metal content is not more than 0.5 ppm and the number of fine particles of not less than 0.2 μm is 200 or less per 1 ml.

Examples of impurity metals in ultra pure water are, for instance, Na, Fe, Cr, As, Al, Ba, and the like, and the fine particles mean algae, secretion of microorganisms in water, dead microorganisms, dust in the air, and the like.

The ultra pure water can be prepared by taking the steps from dechlorination of raw water, reverse osmosis (Ro) treatment, membrane treatments such as cartridge type water purifier, ultrafiltration (UF) and microfiltration (MF), sterilization by ultraviolet rays through deaeration treatment, thereby increasing purity and removing microorganisms, fine particles and organic substances.

The method of washing of the first cleaning method is not limited particularly, and it is preferable to carry out washing by showering, spraying, jet-scrubbing, dipping or ultrasonic or megasonic cleaning. Also it is preferable to carry out cleaning with boiling water from the point that fine particles can be removed effectively and efficiently.

Washing is conducted once or two or more times. The number of washing steps is not particularly limited as far as the number of particles having a specific particle size on a surface of cleaned molded article is in the range specified hereinafter. The washing may be carried out once in case of a combination with other cleaning methods. In case of the first cleaning method only, it is preferable to carry out the washing two or more times.

In the first cleaning method, from the viewpoint of enhancing removal efficiency of particles, a temperature of ultra pure water at washing is preferably from 20° to 100° C., especially 40° to 100° C. From the point that fine particles can be removed effectively and efficiently, it is preferable to carry out washing with boiling water. A boiling water temperature is from 70° to 100° C., preferably 80° to 100° C., especially 90° to 100° C. A boiling time is from 0.5 to 5 hours. At the time of washing with boiling water, from the viewpoint of effective use of ultra pure water, it is preferable that ultra pure water is subjected to refluxing.

An atmosphere is not limited particularly. However from the viewpoint of preventing fine particles from mixing, it is preferable to carry out the washing in an atmosphere in clean room, clean bench, clean tunnel, and the like.

The first method of cleaning with ultra pure water is also capable of removing other contaminants, and is particularly suitable as a method for removing ions such as $F^-$, $SO_4^{2-}$ and $Cl^-$ which are contained in or adhered to the fluorine-containing rubber molded article.

It is possible to not only reduce water content but also remove organic components contained in the air and adhered to the molded article, by heat-treating, after the washing, usually in a cleaned inert gas atmosphere such as nitrogen gas, argon gas or helium gas or by flowing the inert gas at 50° to 300° C., preferably 100° to 250° C. for 1 to 72 hours, preferably 1 to 24 hours.

Usually a particle size of particles on the surface of fluorine-containing rubber molded article is not less than 0.2 μm, and 500,000 to 1,000,000 particles/cm$^2$ are present on the surface of molded article. On the contrary, the number of particles having a particle size of not less than 0.2 μm and being present on the surface of fluorine-containing rubber molded article cleaned by the above-mentioned first cleaning method is not more than 100,000/cm$^2$. The number of particles having a particle size of not less than 0.2 μm is preferably not more than 50,000/cm$^2$, especially not more than 20,000/cm$^2$. It is a matter of course that the number of particles having a particle size exceeding 0.5 μm is as few as possible, preferably not more than 10,000/cm$^2$, especially 5,000/cm$^2$.

Herein particles mean dusts mixed in each production step of molded article, processing aids such as a releasing agent and organic residues such as fatty acid derived from human body. It is preferable to use a vessel laminated with a fluorine-containing resin film or polyethylene resin film, a vessel made of fluorine-containing rein and a vessel made of polyethylene so that the molded article should not come into contact with a metal.

Then methods of measuring a size and the number of particles being present on the surface of the cleaned fluorine-containing rubber molded article and methods of evaluation thereof are explained below.

In the present invention, the molded article is dipped in water, and the size and the number of particles coming out of the molded article into water are measured by the methods mentioned below. The measuring methods are roughly classified into a direct method and an indirect method. The direct method is a method of counting the number of particles in water by a particle size, and the indirect method is a method of indicating a degree of blockage of a specific membrane filter for evaluation.

Herein the measuring method represented by the direct method is explained below in detail. As the direct method, there are three methods, i.e. ① direct microscopic method, ② electron microscopic method and ③ fine particle meter method.

In the method ①, water is passed through a membrane filter and particles caught on the surface of the membrane filter are observed and measured with an optical microscope. The method ② is nearly the same as the method ①, but measurement is done by using a scanning electron microscope instead of the optical microscope. In the method ③, the number and size of particles are measured by emitting light to water containing particles and flowed into a sensor part and then measuring electrically amounts of transmitted light and scattered light with a particle counter.

Then the second method of cleaning the fluorine-containing rubber molded article for semiconductor production apparatuses according to the present invention is explained.

The second cleaning method of the present invention is the method of cleaning the fluorine-containing rubber molded article for semiconductor production apparatuses, which comprises washing the fluorine-containing rubber molded article once or two or more times with an organic compound or inorganic compound which has a metal content of not more than 1.0 ppm, does not contain fine particles of not less than 0.5 μm in an amount of more than 200 per 1 ml and is in liquid form at a washing temperature.

Examples of the organic compound in the form of liquid which is used for the second cleaning method of the present invention are, for instance, ketones such as acetone and methyl ethyl ketone; alcohols such as methyl alcohol, ethyl alcohol and isopropyl alcohol; hydrocarbons such as hexane, octane and xylene; chlorine-based hydrocarbons such as trichloroethylene, tetrachloroethylene and carbon tetrachloride; fluorine-based hydrocarbons such as perfluorobenzene, perfluorohexane and 1,1-dichloro-1-fluoroethane; ethers such as diethyl ether; esters such as methyl acetate and ethyl acetate; and the like. Those compounds can be used in optional combination thereof.

Examples of the inorganic compound in the form of liquid are, for instance, $H_2SO_4$, $HNO_3$, $H_2O_2$, HF, $O_3$ (aqueous ozone solution), $NH_4OH$, HCl , and the like. Those compounds can be used in an optional combination thereof. Particularly a solution of $H_2SO_4/H_2O_2$ mixture, a solution of $HCl/H_2O_2$ mixture, a solution of $O_3$/HF mixture, a solution of $O_3/H_2SO_4$ mixture, a solution of $O_3$/HCl mixture, an aqueous solution of HF are usually used in semiconductor production process, and are suitable as a cleaning solution.

A metal content of the above-mentioned organic compound or inorganic compound in the form of liquid which is used in the second cleaning method of the present invention is not more than 1.0 ppm. From the point of reduction of metal mixing in the molded article, the metal content is preferably not more than 0.8 ppm, especially not more than 0.5 ppm.

Metals which may be contained in the above-mentioned organic compound or inorganic compound in the form of liquid are Na, Fe, Cr, As, Al, Ba, and the like.

Also the above-mentioned organic compound or inorganic compound in the form of liquid does not contain fine particles of not less than 0.5 $\mu$m in an amount of more than 200 per 1 ml from the viewpoint of reduction of adhering amount of fine particles onto the molded article. The number of fine particles of not less than 0.5 $\mu$m is preferably not more than 150 per 1 ml, especially not more than 100 per 1 ml.

The fine particles which may be contained in the above-mentioned organic compound or inorganic compound in the form of liquid mean dusts in the air, fine particles to be mixed in the production process, fine particles adhering to an inner wall of a storage vessel, a processing aid contained in the inner wall of a storage vessel, and the like.

In order to satisfy the above-mentioned requirements, a temperature of the above-mentioned organic compound or inorganic compound in the form of liquid at the time of washing is preferably not less than 20° C. and less than its boiling point.

As the organic compound or inorganic compound in the form of liquid, compounds which are commercially available and have a grade for electronic industries can be used.

An object of the second cleaning method is roughly classified into two. One is to remove impurity organic components by an inorganic compound or organic compound having an oxidizing ability. For that purpose, inorganic compounds such as a solution of $H_2SO_4/H_2O_2$ mixture and an aqueous solution of $O_3$; organic compounds such as acetone, methyl ethyl ketone and isopropyl alcohol are suitable. Another object is to remove impurity metal components by an inorganic compound having a strong ability of dissolving metals. For this purpose, inorganic acids such as HF, HCl, $H_2SO_4$ and $HNO_3$ and the above-mentioned solution of $H_2SO_4/H_2O_2$ mixture are suitable.

The method of washing of the second cleaning method is not limited particularly, and it is preferable to carry out washing by showering, spraying, jet-scrubbing, dipping or ultrasonic or megasonic cleaning. Also it is preferable to carry out washing by boiling from the point that fine particles can be removed effectively and efficiently. A boiling temperature is from 70° to 100° C., preferably 80° to 100° C. A boiling time is from 0.5 to 5 hours. At the time of washing by boiling, from the viewpoint of effective use of the inorganic compound or organic compound, it is preferable that the inorganic compound or organic compound in the form of liquid is subjected to refluxing.

In the second cleaning method, an atmosphere at washing is not limited particularly. However from the viewpoint of preventing fine particles from mixing, it is preferable to carry out the washing in an atmosphere in clean room, clean bench, clean tunnel, and the like.

The number of washing steps is not particularly limited as far as the number of particles on a surface of cleaned molded article is in the range specified hereinafter. Washing may be conducted plural times. Also the washing with ultra pure water which is explained in the first cleaning method may be carried out once or two or more times before and/or after the second cleaning method. Further it is preferable to carry out the heat treatment after the washing which is explained in the first cleaning method.

The number of particles having a particle size of not less than 0.2 $\mu$m and being present on the surface of fluorine-containing rubber molded article cleaned by the above-mentioned second cleaning method of the present invention is not more than 100,000/cm$^2$. From the viewpoint of a decrease in the number of particles to be generated, the number of particles having a particle size of not less than 0.2 $\mu$m is preferably not more than 50,000/cm$^2$, especially not more than 20,000/cm$^2$.

The methods of measuring a size and the number of particles being present on the surface of the cleaned fluorine-containing rubber molded article and methods of evaluation thereof are the same as in the above-mentioned first cleaning method.

Then the cleaning by dry etching which is employed in the third cleaning method of the present invention is explained. Generally the cleaning by dry etching is a method of chemically and/or physically decomposing particles being present on the surface of articles to be cleaned by bringing a gas having a high chemical reactivity, excited gas or light into contact with the articles.

As the cleaning method by dry etching, there are methods of UV/$O_3$ irradiation, ion beam irradiation, laser beam irradiation, plasma irradiation and gas etching.

Namely the third cleaning method of the present invention is a method of cleaning of the fluorine-containing rubber molded article for semiconductor production apparatuses by dry etching by UV/$O_3$ irradiation, ion beam irradiation, laser beam irradiation, plasma irradiation or gas etching.

The third cleaning method of the present invention is suitable particularly for removal of impurity organic components.

Those methods of cleaning by dry etching are explained below.

(1) Cleaning Method with UV/$O_3$

The cleaning with UV/$O_3$ is a method of irradiating ultraviolet rays to an article to be cleaned to directly decompose or activate an organic substance adhering on its surface, then easily subjecting to oxidization, and at the same time to decompose and modify the impurity organic substance into a volatile substance by an action of activated oxygen separated from ozone generated by an action of ultraviolet rays.

Thus the impurity organic substance is removed. For example, $UV/O_3$ cleaning equipment commercially available from Eye Graphics Co., Ltd., Ushio Inc., etc. can be used suitably.

(2) Cleaning Method by Ion Beam

The cleaning by ion beam is a physical etching method for removing particles by accelerating charged particles such as argon ions in a low pressure chamber, taking out the ion beam and then irradiating the beams against the article to be cleaned, thus removing particles. Ion beam etching equipment is commercially available from IONTECH CO., LTD., etc., and the commercially available equipment can be used suitably in the present invention.

(3) Cleaning Method by Laser Beam

The cleaning by laser beam is a method of cleaning by irradiating high performance ruby laser pulses against the article to be cleaned. Equipment for laser beam etching is also available commercially, and can be used suitably in the present invention.

(4) Cleaning Method by Plasma

Cleaning by plasma is a method of cleaning by utilizing an active oxygen plasma generated by introducing oxygen gas into high frequency electric field. According to this method, an organic substance is oxidized and finally converted to $CO_2$ and $H_2O$ and exhausted for removal. Plasma ashing equipment to be used for the cleaning by plasma is commercially available, and can be used suitably in the present invention.

(5) Cleaning Method by Gas Etching

A gas to be used suitably for the cleaning by gas etching is a hydrofluoric anhydride gas. An aimed substance is removed by properly adjusting a pressure and temperature. In this method, fluorine gas, ozone gas, hydrofluoric anhydride gas are used, and among them, a mixed gas of hydrofluoric anhydride gas, anhydrous fluorine gas and ozone gas is suitable. Particles can be removed by bringing those gases into contact with an article to be cleaned and properly adjusting a pressure and temperature of an atmosphere.

Then the fourth cleaning method of the present invention is a method of cleaning the fluorine-containing rubber molded article for semiconductor production apparatuses by extraction cleaning of the fluorine-containing rubber molded article.

The fourth cleaning method is suitable particularly for removing impurity organic components.

Examples of the extraction cleaning method in the present invention are Soxhlet extraction cleaning, high temperature high pressure extraction cleaning, microwave extraction cleaning and supercritical extraction cleaning. Those extraction cleaning methods are explained below.

(1) Soxhlet Extraction Cleaning Method

This extraction cleaning is carried out by using a device equipped with a circulating type cooler, extraction tube and solvent flask. A sample is put in the extraction tube, and an upper end of the tube is connected to the cooler and a lower end thereof is connected to the flask charged with a solvent. The device is so designed that the extraction tube is provided with a side tube playing a role as a siphon, and when the solvent in the flask is heated, steam generated goes up through the side tube, is condensed in the cooler to become a liquid and is dropped onto the sample, and when the dropped liquid reaches a top level of the siphon, it returns to the flask through the side tube, thus carrying out the extraction.

(2) High Temperature High Pressure Extraction Cleaning Method

This is a method of extracting by using a solvent. The extraction is carried out by bringing the solvent into contact with a sample at high temperature at high pressure.

(3) Microwave Extraction Cleaning Method

A microwave is emitted to the solvent to rapidly heat it. The extraction is carried out with the heated solvent. Equipment for this method is also commercially available, and can be used suitably in the present invention.

(4) Supercritical Extraction Cleaning Method

Supercritical extraction is an equilibrium separation method, in which a supercritical liquid (high density gas) to be used as a separating solvent is brought into contact with a substance to be separated (particles) and a difference in solubility of the components to be extracted in the solvent is used. Generally $CO_2$ gas is used as a supercritical fluid, and in addition, fluid gases such as ethane, $N_2O$ and water are used. Also to enhance extraction of polar substances, in many cases, a mixed liquid to which alcohol, ketone or the like is added in an amount of several percents is used. Equipment used for this method is also commercially available, and can be used suitably in the present invention.

After the cleaning treatment, the above-mentioned heat-treatment may be carried out.

The number of particles of not less than 0.2 $\mu$m being present on the surface of the fluorine-containing rubber molded article cleaned by those dry etching methods or extraction cleaning methods is not more than 100,000/cm$^2$, preferably not more than 50,000/cm$^2$, especially not more than 20,000/cm$^2$.

The above-mentioned first, second, third and fourth cleaning methods of the present invention can be used in an optional combination thereof.

While the features of each cleaning method are explained above, mentioned below are explanation on the cleaning methods of the present invention classified by items to be removed (purpose of cleaning).

Firstly examples of the particularly effective method (A) of removing organic components contained in the air and causing an organic gas and impurity organic components such as a releasing agent used at molding are the following four cleaning methods.

(A-1) The second cleaning method employing an inorganic compound having an oxidizing ability (A-2) The second cleaning method employing an organic compound having an oxidizing ability (A-3) The third cleaning method by dry etching (A-4) The fourth extraction cleaning method Those methods may be used solely or in a combination of two or more thereof. In case of the combination use, an order of cleaning methods may be optionally selected.

Subsequently the particularly effective method (B) for removing impurity metal components is the second cleaning method using an inorganic compound having an excellent ability of dissolving metal components.

Also the particularly effective method (C) for removing impurity ions (for example, $F^-$, $SO_4^{2-}$, $Cl^-$) is the first cleaning method using ultra pure water.

Further generation of water can be reduced by a drying step for removing water after carrying out those cleaning methods. As the method (D) used for the drying step, there are, for example, a method of drying in an atmosphere or stream of clean inert gas such as nitrogen gas or in vacuum; a method of drying by blowing clean dry air from which organic substances and fine particles have been removed; and the like method.

The clean inert gas or air to be used for the drying (removal of water) means gas or air which has a content of organic components (TOC) of not more than 0.1 ppm and does not contain fine particles of not less than 0.2 μm in an amount of more than 26 per 1 liter (This is an environment of so-called class 100).

In order to remove all the above-mentioned impurities effectively, it is desirable to carry out the above-mentioned methods (A) to (D) in the order of (A)→(B)→(C)→(D) or (B)→(A)→(C)→(D). In the cleaning method (A), one of the methods (A-1) to (A-4) or a combination of two or more thereof may be employed.

Particularly in case of sealing materials for semiconductor, and the like, where a decrease in the number of particles, a decrease in an amount of ions, a reduction of generation of organic gas and a reduction of generation of water are demanded strongly, it is particularly preferable to combine cleaning with a solution of $H_2SO_4/H_2O_2$ mixture and cleaning with an aqueous solution of HF and further carry out cleaning with boiled ultra pure water and then drying by heating in a clean inert gas stream.

The fluorine-containing rubber molded article cleaned by those methods can be suitably used as a molded article such as a sealing material for production apparatuses in semiconductor industries where scale down is further accelerated and cleanliness is demanded.

Examples of the sealing material are O-ring, square ring, gasket, packing, oil seal, bearing seal, lip seal, and the like. In addition, the molded article can be used for various elastomer products such as diaphragm, tube, hose and various rubber rolls, and also can be used as a coating material and lining material.

In the present invention, the semiconductor production apparatuses are not limited particularly to equipment for producing semiconductors, but widely includes whole production apparatuses used in the field of semiconductor where high cleanliness is demanded, such as equipment for producing liquid crystal panel and plasma panel.

The fluorine-containing rubber molded article can be used built in the following semiconductor production apparatuses.

(1) Etching System

Dry etching equipment
Plasma etching device
Reactive ion etching device
Reactive ion beam etching device
Sputter etching device
Ion beam etching device
Wet etching equipment
Ashing equipment (2) Cleaning System Dry etching cleaning equipment
$UV/O_3$ cleaning device
Ion beam cleaning device
Laser beam cleaning device
Plasma cleaning device
Gas etching cleaning device
Extraction cleaning equipment
Soxhlet extracting cleaning device
High temperature high pressure extracting cleaning device
Microwave extracting cleaning device
Supercritical extracting cleaning device (3) Exposing System Stepper
Coater developer (4) Polishing System CMP equipment (5) Film Forming System CVD equipment
Sputtering equipment (6) Diffusion/Ion Implantation System Oxidation diffusion equipment
Ion implantation equipment The present invention is then explained based on examples but is not limited to those examples.

EXAMPLE 1

The Fourth Method of Cleaning of the Present Invention by Using Ultra Pure Water Ultra pure water which had a metal content of not more than 1.0 ppm and did not contain fine particles of not less than 0.2 μm in an amount of more than 300 per 1 milliliter was obtained by conducting dichlorination of raw water, carrying out reverse osmosis (Ro) treatment, ultrafiltration (UF) and microfiltration (MF) plural times and then conducting sterilization with ultraviolet rays and deaeration treatment.

In that case, a metal content (ppm) was measured with an atomic absorption analysis, and the number of fine particles of not less than 0.2 μm (per milliliter) was measured through fine particle meter method (Submerged Particle Counter KL-22 available from Kabushiki Kaisha Lyon was used).

Then a fluorine-containing rubber sealing material produced from tetrafluoroethylene/perfluoro(alkyl vinyl ether) copolymer was cleaned with the obtained ultra pure water by Soxhlet extraction cleaning method at 100° C. The sealing material after cleaning was dipped in 100 ml of ultra pure water and vibrated at an amplitude of 10 cm at the number of vibrations of 2 times/sec for five minutes by using a vibrating machine (TS-4 available from Taiyo Kagaku Kogyo Kabushiki Kaisha), followed by allowing to stand for 20 minutes. Subsequently the number of particles of not less than 0.2 μm (per $cm^2$) which were present on the surface of the sealing material was measured with the above-mentioned submerged particle counter. As a result, the number of particles was 40,000/$cm^2$.

EXAMPLE 2

The Fourth Method of Cleaning of the Present Invention by Using Organic Compound Cleaning of a sealing material was carried out in the same manner as in Example 1 except that acetone in the form of liquid which had a metal content of not more than 1.0 ppm and did not contain fine particles of not less than 0.5 μm in an amount of more than 200 per 1 milliliter was used (commercially available acetone having a grade for electronic industries). A metal content (ppm) of acetone and the number of fine particles of not less than 0.5 μm (per ml) were measured in the same manner as in Example 1.

Then a fluorine-containing rubber sealing material comprising tetrafluoroethylene/perfluoro(alkyl vinyl ether)

copolymer was subjected to Soxhlet extraction cleaning with the above-mentioned acetone in the form of liquid at a boiling point thereof, and the number of fine particles of not less than 0.2 μm (per $cm^2$) which were present on the surface of the cleaned sealing material was measured in the same manner as in Example 1. As a result, the number of fine particles was 68,000/$cm^2$.

EXAMPLE 3

The Second Method of Cleaning of the Present Invention by Using Inorganic Compound A fluorine-containing rubber sealing material comprising tetrafluoroethylene/perfluoro(alkyl vinyl ether) copolymer was subjected to cleaning by dipping at 100° C. for one hour in an aqueous solution of 96% by weight $H_2SO_4$ (being commercially available and having a grade for electronic industry) which had a metal content of not more than 1.0 ppm and did not contain fine particles of not less than 0.5 μm in an amount of more than 200 per 1 milliliter. The number of fine particles of not less than 0.2 μm (per $cm^2$) which were present on the surface of the cleaned sealing material was measured in the same manner as in Example 1. As a result, the number of fine particles was 8,000/$cm^2$. The metal content (ppm) and the number of particles of not less than 0.5 μm (per 1 milliliter) in the above-mentioned aqueous solution of $H_2SO_4$ were measured in the same manner as in Example 1.

EXAMPLE 4

The Third Method of Cleaning of the Present Invention by Using Dry Etching Method A fluorine-containing rubber sealing material comprising tetrafluoroethylene/perfluoro(alkyl vinyl ether) copolymer was cleaned by irradiation for five minutes from a distance of 65 mm by using a UV/$O_3$ cleaning device Model a-35003 available from Eye Graphics Co., Ltd. The number of fine particles of not less than 0.2 μm (per $cm^2$) which were present on the surface of the cleaned sealing material was measured in the same manner as in Example 1. As a result, the number of fine particles was 40,000/$cm^2$.

EXAMPLE 5

The First Method of Cleaning of the Present Invention by Using Ultra Pure Water

A fluorine-containing rubber sealing material comprising tetrafluoroethylene/perfluoro(alkyl vinyl ether) copolymer was cleaned by boiling (100° C.) the same ultra pure water as in Example 1 for one hour. The number of fine particles of not less than 0.2 μm which were present on the surface of the so-cleaned sealing material was measured in the same manner as in Example 1. As a result, the number of fine particles was 88,000/$cm^2$.

EXAMPLE 6

The Second Method of Cleaning of the Present Invention by Using an Inorganic Compound Cleaning of a fluorine-containing rubber sealing material comprising tetrafluoroethylene/perfluoro(alkyl vinyl ether) copolymer was carried out in the same manner as in Example 5 except that an aqueous solution of $H_2SO_4$ which was used in Example 3 was used instead of ultra pure water. The cleaning was carried out under the conditions of 100° C. for one hour. The number of fine particles of not less than 0.2 μm which were present on the surface of the cleaned sealing material was measured in the same manner as in Example 1. As a result, the number of fine particles was 29,000/$cm^2$.

EXAMPLE 7

The Second Method of Cleaning of the Present Invention by Using an Inorganic Compound Cleaning of a fluorine-containing rubber sealing material comprising tetrafluoroethylene/perfluoro(alkyl vinyl ether) copolymer was carried out in the same manner as in Example 5 except that HCl in the form of liquid (being commercially available and having a grade for electronic industry) which had a metal content of not more than 1.0 ppm and did not contain fine particles of not less than 0.5 μm in an amount of more than 200 per 1 milliliter was used instead of ultra pure water. The cleaning was carried out under the conditions of 100° C. for one hour. The number of fine particles of not less than 0.2 μm which were present on the surface of the cleaned sealing material was measured in the same manner as in Example 1. As a result, the number of fine particles was 39,000/$cm^2$.

EXAMPLE 8

The Second Method of Cleaning of the Present Invention by Using an Inorganic Compound Cleaning of a fluorine-containing rubber sealing material comprising tetrafluoroethylene/perfluoro(alkyl vinyl ether) copolymer was carried out in the same manner as in Example 5 except that a solution of $H_2SO_4/H_2O_2$ mixture (a mixture of an aqueous solution of 96% by weight $H_2SO_4$ and an aqueous solution of 30% by weight $H_2O_2$ in a ratio of 1/1 (in weight ratio), each aqueous solution being commercially available and having a grade for electronic industry) which had a metal content of not more than 1.0 ppm and did not contain fine particles of not less than 0.5 μm in an amount of more than 200 per 1 milliliter was used instead of ultra pure water. The number of fine particles of not less than 0.2 μm which were present on the surface of the cleaned sealing material was measured in the same manner as in Example 1. As a result, the number of fine particles was 10,000/$cm^2$.

EXAMPLE 9

The Second Method of Cleaning of the Present Invention by Using an Inorganic Compound Cleaning of a fluorine-containing rubber sealing material comprising tetrafluoroethylene/perfluoro(alkyl vinyl ether) copolymer was carried out in the same manner as in Example 5 except that a solution of HCl/$H_2O_2$ mixture (a mixture of an aqueous solution of 35% by weight HCl and an aqueous solution of 30% by weight $H_2O_2$ in a ratio of 1/1 (in weight ratio), each aqueous solution being commercially available and having a grade for electronic industry) which had a metal content of not more than 1.0 ppm and did not contain fine particles of not less than 0.5 μm in an amount of more than 200 per 1 milliliter was used instead of ultra pure water. The number of fine particles of not less than 0.2 μm which were present on the surface of the cleaned sealing material was measured in the same manner as in Example 1. As a result, the number of fine particles was 19,000/$cm^2$.

EXAMPLE 10

A fluorine-containing rubber sealing material comprising tetrafluoroethylene/perfluoro(alkyl vinyl ether) copolymer was subjected to cleaning by dipping at 25° C. for one hour in an aqueous solution of $HF/O_3$ mixture (prepared by using an ozonator SGX-AL11MN available from Sumitomo Seiki Kogyo Kabushiki Kaisha, $O_3$ content: 10 ppm) (a mixture of an aqueous solution of 50% by weight HF (being commercially available and having a grade for electronic industry) and an aqueous solution of $O_3$ in a ratio of 1/1 (in weight ratio)) which had a metal content of not more than 1.0 ppm and did not contain fine particles of not less than 0.5 μm in an amount of more than 200 per 1 milliliter. The number of fine particles of not less than 0.2 μm which were present on the surface of the cleaned sealing material was measured in the same manner as in Example 1. As a result, the number of fine particles was 68,000/cm$^2$.

EXAMPLE 11

The Fourth Method of Cleaning of the Present Invention by Supercritical Extraction The same sealing material as in Example 1 was subjected to extraction cleaning for two hours by using supercritical fluid $CO_2$ of 300 kg/cm$^2$ and 45° C. The number of fine particles of not less than 0.2 μm which were present on the surface of the cleaned sealing material was measured in the same manner as in Example 1. As a result, the number of fine particles was 49,000/cm$^2$.

COMPARATIVE EXAMPLE

With respect to the sealing material before cleaning which was used in Example 1, the number of fine particles of not less than 0.2 μm was measured, and as a result, the number of fine particles was 500,000/cm$^2$.

EXAMPLE 12

(1) Emulsion Polymerization Step

A 6,000-milliliter pressure resistant stainless steel reactor was charged with 2 liters of ultra pure water, 20 g of emulsifying agent ($C_7F_{15}COONH_4$) and 18 g of pH control agent (ammonium carbonate). After replacing inside of the reactor with nitrogen gas sufficiently, the reactor was heated up to 50° C. with stirring at 600 rpm and a mixture of tetrafluoroethylene and perfluoro(methyl vinyl ether) (TFE/PMVE=20/80, mole ratio) was introduced under pressure so that the inside pressure became 12.0 kgf/cm$^2$G. When 2 ml of aqueous solution of 186 mg/ml ammonium persulfate (APS) as a polymerization initiator was introduced with pressurized nitrogen, immediately a polymerization reaction started and lowering of the inside pressure occurred. When the pressure lowered down to 11.0 kgf/cm$^2$G, 4.0 g of diiodine compound $I(CF_2)_4I$ was introduced under pressure. Then 19.0 g of TFE was fed with its self-pressure and 23.0 g of PMVE was fed under pressure with a plunger pump. In that manner, raising and lowering of the pressure were repeated. At the time when a total amount of TFE and PMVE reached 430 g, 511 g and 596 g, respectively, 1.5 g each of iodine compound $ICH_2CF_2CF_2OCF{=}CF_2$ (IM) was introduced under pressure. During the polymerization, every 12 hours after initiating the reaction, 2 ml of aqueous solution of 35 mg/ml APS was introduced with pressurized nitrogen gas.

Thirty-four hours after starting of the polymerization reaction, when a total amount of TFE and PMVE reached 860 g, the autoclave was cooled and un-reacted monomer was released to give an aqueous dispersion having a solid content of 30.0% by weight.

(2) Coagulation Step

Dilution of 4.0 g of the aqueous dispersion obtained in (1) above was carried out with 15.7 g of ultra pure water, and the diluted aqueous dispersion was added dropwise in 12 g of a coagulating agent (Suprapur available from MERCK & CO., INC.: Aqueous solution of 3.5% HCl of semiconductor grade) in a beaker made of PFA to carry out coagulation. Thus a water-containing elastomer was obtained.

(3) Drying Step

The obtained elastomer containing a solvent was put on a fluorine-containing resin (PFA) film and was dried at 150° for 12 hours in an oven, the inside of which had been adjusted to an environment of class 100 (Number of particles: not more than 26 per liter) and TOC of not more than 0.01 ppm with heat resistant HEPA filter. Thereby a cleaned fluorine-containing elastomer was obtained.

Four kinds of crosslinkable elastomer compositions were prepared with components shown in Table 1 by using the cleaned fluorine-containing elastomer. The elastomer composition was subjected to press-crosslinking (primary crosslinking) at 160° C. for 10 minutes and then crosslinking (secondary crosslinking) in an oven at 180° C. for four hours to give an O-ring (AS-568A-214). The number of particles of the O-ring before cleaning was measured by the above-mentioned method, and an amount of generated organic gas and an amount of generated water were measured by the methods mentioned below. The results are shown in Table 1.

Then the O-ring (AS-568A-214) was subjected to cleaning with the same solution of $H_2SO_4/H_2O_2$ mixture (1/1) as in Example 8 at 100° C. for 15 minutes, and then with 50% aqueous solution of HF at 25° C. for 15 minutes. After that, the O-ring was further cleaned with boiled ultra pure water at 100° C. for two hours, and then heated at 180° C. for 24 hours in a high purity nitrogen gas stream of 20 ml/min (volume: 40×40×40 cm) to remove water therefrom. The number of particles of the obtained final products and the products after plasma irradiation was measured by the above-mentioned method, and an amount of generated organic gas, ion concentration and amount of generated water were measured by the methods mentioned below. The results are shown in Table 1.

Amount of Generated Organic Gas

The O-ring (AS-568A-214) is put in a closed tube, and after the tube is heated at 200° C. for 15 minutes, generated gas is collected in a trap tube cooled to −40° C. with liquid nitrogen and is then rapidly heated and analyzed with a gas chromatograph (GC-14A available from Shimadzu Corporation, Column: UA-5 available from Shimadzu Corporation).

Amount of Water Generation

The O-ring (AS-568A-214) is heated at 300° C. for 30 minutes, and then an amount of generated water is measured with Karl Fischer type water meter (AQS-720 available from Hiranuma Kabushiki Kaisha).

Ion Concentration

A vessel made of polypropylene is charged with 50 ml of ultra pure water and the O-ring (AS-568A-2 14) and heat-treated at a pressure of 1.1 kgf/cm$^2$ at 120° C. for one hour in an autoclave. Then an ion ($F^-$, $SO_4^{2-}$ and $Cl^-$) concentration of the ultra pure water after the treatment was measured with Ion Chromatograph (IC-7000) available from Shimadzu Corporation.

Components in Table 1 are as follows.

Fluorine-containing elastomer: TFE/PMVE/IM copolymer

TAIC: Triallylisocyanurate

PERHEXA 2.5B: 2,5-dimethyl-2,5-di(t-butylperoxy)hexane (available from NOF Corporation)

TOKABLACK: Graphitized carbon black filler #3885 available from TOKAI CARBON KABUSHIKI KAISHA 1-FX: Ultra high purity spheroidal synthetic quartz silica available from KABUSHIKI KAISHA TATSUMORI LUBRON LSF: Low molecular weight polytetrafluoroethylene filler available from DAIKIN INDUSTRIES, LTD.

The following plasma resistance test was carried out by using the O-ring, and the number of generated particles was determined. The results are shown in Table 1.

Plasma Resistance Test

Plasma was generated under the conditions of a vacuum pressure of 50 mTorr, an oxygen flow of 200 cc/min, electric power of 400 W and a frequency of 13.56 MHz by using Plasma Dry Cleaner Model PX-1000 available from Kabushiki Kaisha Samco International Kenkyusho, and the generated oxygen plasma was irradiated to the samples (O-ring) under the reactive ion etching (RIE) conditions for three hours.

TABLE 1

| | Elastomer composition | | | |
|---|---|---|---|---|
| | A (Transparent) | B (Black) | C (White) | D (Milky white) |
| Fluorine-containing elastomer (g) | 100 | 100 | 100 | 100 |
| TAIC (g) | 2.0 | 2.0 | 2.0 | 2.0 |
| PERHEXA 2.5B (g) | 0.5 | 0.5 | 0.5 | 0.5 |
| TOKABLACK (g) | — | 10.0 | — | — |
| 1-FX (g) | — | — | 10.0 | — |
| LUBRON LSF (g) | — | — | — | 25.0 |
| Before cleaning | | | | |
| Amount of generated organic gas (relative value) | 508 | 1206 | 993 | 1776 |
| Amount of generated water (ppm) | 48.7 | 137.3 | 450.7 | 121.8 |
| Number of particles ($\times 10^4/cm^2$) | 13.22 | 16.07 | 14.26 | 13.81 |
| After cleaning | | | | |
| Amount of generated organic gas (relative value) | 100 | 118 | 100 | 135 |
| Amount of generated water (ppm) | 9.8 | 11.5 | 18.2 | 7.3 |
| Number of particles ($\times 10^4/cm^2$) | 0.83 | 1.23 | 0.83 | 0.84 |
| Number of particles after plasma irradiation ($\times 10^4/cm^2$) | 1.53 | 1.31 | 2.66 | 1.59 |
| Ion concentration ($\mu g/g$) | | | | |
| $F^-$ | 0.145 | 0.210 | 0.145 | 0.140 |
| $SO_4^{2-}$ | 0.250 | 0.230 | 0.235 | 0.210 |
| $Cl^-$ | 0.200 | 0.310 | 0.240 | 0.225 |

With respect to the obtained final product, i.e. O-ring (before plasma irradiation), an amount of extracted metal was determined according to the method mentioned below. The results are shown in Tables 2 and 3.

(1) A chemical solution for extraction is put in a PFA vessel (with a lid) previously washed sufficiently.

(2) A chemical solution ($H_2SO_4/H_2O_2$ (4/1) (Table 2) or 50% HF (Table 3)) to be used is of semiconductor grade.

(3) A sample O-ring is dipped in the respective chemical solutions (at 25° C. for 14 days in case of $H_2SO_4/H_2O_2$ mixture, at 25° C. for 24 hours in case of 50% HF), and is allowed to stand at the specified temperature after sealing of the vessel. In that case, a vessel containing only a chemical solution without dipping a sample is a control.

(4) After allowing to stand for an optional period of time, metal concentrations in the chemical solution are measured with ICP-MS (SPQ9000 available from Seiko Denshi Kabushiki Kaisha) for the $H_2SO_4/H_2O_2$ mixture (Table 2) and with atomic absorption spectrometer (Z-8000 available from Hitachi, Ltd.) for 50% HF (Table 3).

(5) Amounts of metals extracted from the O-ring are calculated from the following equation.

$$\text{Amount of extracted metal} = \left\{\begin{matrix}\text{(Metal concentration in} \\ \text{chemical solution with} \\ \text{dipping O-ring)}\end{matrix} - \begin{matrix}\text{(Metal concentration in} \\ \text{chemical solution without} \\ \text{dipping O-ring)}\end{matrix}\right\} \div \text{(Weight of O-ring)} \times \text{(Weight of chemical solution)}$$

TABLE 2

| | Amount of extraction (ppm) | | | | Detection |
|---|---|---|---|---|---|
| Metal | A | B | C | D | limit (ppb) |
| Fe | 10 | 20 | 10 | 10 | 5 |
| Ni | 40 | ND | 10 | 400 | 0.9 |
| Cu | 3 | 2 | 8 | 2 | 0.1 |
| Na | 1 | 30 | 10 | 5 | 0.2 |
| K | ND | ND | ND | ND | 10 |
| Ca | ND | ND | ND | ND | 5 |

TABLE 2-continued

| Metal | Amount of extraction (ppm) A | B | C | D | Detection limit (ppb) |
|---|---|---|---|---|---|
| Mg | 20 | 4 | 4 | 4 | 0.1 |
| Al | 3 | 2 | 4 | 10 | 0.1 |

TABLE 3

| Metal | Amount of extraction (ppb) A | B | C | D | Detection limit (ppb) |
|---|---|---|---|---|---|
| Fe | 5.0 | 50.0 | 20.0 | 9.0 | 5 |
| Cr | 3.0 | ND | 3.0 | 2.0 | 2 |
| Ni | ND | ND | ND | ND | 4 |
| Cu | ND | ND | ND | ND | 0.1 |
| Na | 1.0 | ND | 2.0 | 1.0 | 0.5 |
| K | ND | ND | ND | 1.0 | 0.7 |
| Ca | ND | 7.0 | 20.0 | 30.0 | 7 |
| Mg | 1.0 | 20.0 | 7.0 | 1.0 | 0.2 |
| Zn | 30.0 | 20.0 | 30.0 | 8.0 | 0.6 |
| Al | ND | ND | ND | ND | 2 |

EXAMPLE 13

A crosslinkable elastomer composition was prepared by kneading the components of white composition of Example 12 (C of Table 1) by using the cleaned fluorine-containing elastomer obtained by polymerizing, coagulating and drying in the same manner as in Example 12. The elastomer composition was subjected to press-crosslinking at 160° C. for 10 minutes to give an O-ring (AS-568A-214). An amount of generated organic gas and the number of particles of the O-ring were determined by the above-mentioned methods.

Further after the O-ring was cleaned by the same method as in Example 12, an amount of generated organic gas and the number of particles were determined. The results are shown in Table 4.

TABLE 4

| | Before cleaning | After cleaning |
|---|---|---|
| Amount of generated organic gas (relative value) | 23,762,100 | 100 |
| Number of particles ($\times 10^4/cm^2$) | 30.0 | 14.26 |

INDUSTRIAL APPLICABILITY

According to the present invention, a novel and effective cleaning method which can give the cleaned fluorine-containing rubber molded article for semiconductor production apparatuses can be provided.

The semiconductor production apparatuses which are equipped with that fluorine-containing rubber molded article can produce semiconductors in higher yield since particles, metal components, impurity outgas and ion components which are generated from the molded article can be reduced sufficiently.

We claim:

1. A method of cleaning a fluorine-containing rubber molded article for semiconductor production apparatuses, said fluorine-containing rubber molded article containing an elastomeric segment, which comprises washing the fluorine-containing rubber molded article once or two or more times with ultra pure water, said water having a metal content of not more than 1.0 ppm and said water not containing fine particles of not less than 0.2 $\mu$m in an amount of more than 300 per 1 ml.

2. The method of cleaning of claim 1, wherein the washing is carried out at a temperature of not less than 70° C.

3. A method of cleaning a fluorine-containing rubber molded article for semiconductor production apparatuses, said fluorine-containing rubber molded article containing an elastomeric segment, which comprises washing the fluorine-containing rubber molded article once or two or more times with an organic compound or an inorganic compound, which organic compound or inorganic compound has a metal content of not more than 1.0 ppm, which organic compound or inorganic compound does not contain fine particles of not less than 0.5 $\mu$m in an amount of more than 200 per 1 ml, and which organic compound or inorganic compound is in liquid form at a washing temperature.

4. The method of cleaning of claim 3, wherein said organic compound or inorganic compound has an oxidizing ability and said inorganic compound being selected from the group consisting of a solution of a $H_2SO_4/H_2O_2$ mixture and an aqueous solution of $O_3$.

5. The method of cleaning of claim 3, wherein said inorganic compound is selected from the group consisting of HF, HCl, $H_2SO_4$, $HNO_3$ and a $H_2SO_4/H_2O_2$ mixture.

6. A method of cleaning a fluorine-containing rubber molded article for semiconductor production apparatuses, which comprises dry etching the fluorine-containing rubber molded article.

7. A method of cleaning a fluorine-containing rubber molded article for semiconductor production apparatuses, said fluorine-containing rubber molded article containing an elastomeric segment, which comprises extraction cleaning the fluorine-containing rubber molded article, said extraction cleaning comprising at least one selected from the group consisting of Soxhlet extraction cleaning, contacting with a heated solvent under pressure, contacting with a solvent heated by microwaves and contacting with a fluid in supercritical state.

8. A method of cleaning a fluorine-containing rubber molded article for semiconductor production apparatuses, said fluorine-containing rubber molded article containing an elastomeric segment, which comprises:

(a) washing the fluorine-containing rubber molded article once or two or more times with an organic compound having an oxidizing ability or an inorganic compound having an oxidizing ability, which organic compound or inorganic compound has a metal content of not more than 1.0 ppm, which organic compound or inorganic compound does not contain fine particles of not less than 0.5 $\mu$m in an amount of more than 200 per 1 ml, and which organic compound or inorganic compound is in liquid form at a washing temperature, said inorganic compound being a compound selected from the group consisting of a solution of a $H_2SO_4/H_2O_2$ mixture and an aqueous solution of $O_3$;

(b) washing the fluorine-containing rubber molded article once or two or more times with an inorganic compound, which inorganic compound has a metal content of not more than 1.0 ppm, which inorganic compound does not contain fine particles of not less than 0.5 $\mu$m in an amount of more than 200 per 1 ml and which inorganic compound further is in liquid form at a washing temperature, said inorganic compound being selected from the group consisting of HF, HCl, $H_2SO_4$, $HNO_3$ and a $H_2SO_4/H_2O_2$ mixture;

(c) washing the fluorine-containing rubber molded article once or two or more times with water which has a metal content of not more than 1.0 ppm and which water does not contain fine particles of not less than 0.2 $\mu$m in an amount of more than 300 per 1 ml; and (d) removing water from the fluorine-containing rubber molded article in an inert gas or air, which inert gas or air does not contain fine particles of not less than 0.2 $\mu$m in an amount of more than 26 per 1 liter and has a content of organic component (TOC) of not more than 0.1 ppm, wherein after carrying out steps (a) and (b) in sequential or reverse order, step (c) follows steps (a) or (b), and step (d) follows step (c).

9. The cleaning method of claim 8, wherein the fluorine-containing rubber molded article is a fluorine-containing rubber sealing material.

10. A method of cleaning a fluorine-containing rubber molded article for semiconductor production apparatuses, which comprises washing the fluorine-containing rubber molded article with an aqueous solution of a mixture of $H_2SO_4$ and $H_2O_2$, which mixture has a metal content of not more than 1.0 ppm and which mixture does not contain fine particles of not less than 0.5 $\mu$m in an amount of more than 200 per 1 ml, followed by washing the fluorine-containing rubber molded article with an aqueous solution of HF which has a metal content of not more than 1.0 ppm and which aqueous solution of HF does not contain fine particles of not less than 0.5 $\mu$m in an amount of more than 200 per 1 ml, washing the fluorine-containing rubber molded article with water which has a metal content of not more than 1.0 ppm and which water does not contain fine particles of not less than 0.2 $\mu$m in an amount of more than 300 per 1 ml, and then drying the fluorine-containing rubber molded article in an inert gas or air, which inert gas or air does not contain fine particles of not less than 0.2 $\mu$m in an amount of more than 26 per 1 liter and which inert gas or air has a content of organic component (TOC) of not more than 0.1 ppm.

* * * * *